US006729618B1

(12) United States Patent
Koenig et al.

(10) Patent No.: US 6,729,618 B1
(45) Date of Patent: May 4, 2004

(54) METHOD AND APPARATUS FOR PLAYING A GAME UTILIZING A PLURALITY OF SOUND LINES WHICH ARE COMPONENTS OF A SONG OR ENSEMBLE

(75) Inventors: Nicholas Koenig, Corralitos, CA (US); Charles R. Berg, San Jose, CA (US)

(73) Assignee: IGT, Reno, NV (US)

( * ) Notice: Subject to any disclaimer, the term of this patent is extended or adjusted under 35 U.S.C. 154(b) by 239 days.

(21) Appl. No.: 09/643,130

(22) Filed: Aug. 21, 2000

(51) Int. Cl.[7] ..... A63F 9/22

(52) U.S. Cl. ..... 273/138.2; 463/20; 463/35; 463/43; 273/143 R; 273/274

(58) Field of Search ..... 434/307.4, 308, 434/309, 318, 319; 463/17, 18, 19, 20, 22, 25, 26, 35, 43, 12, 13; 273/138.1, 143 R, 142 B, 273, 274

(56) References Cited

U.S. PATENT DOCUMENTS 5,429,513 A * 7/1995 Diaz-Plaza
5,630,754 A * 5/1997 Rebane
812,688 A * 9/1998 Gibson
D416,054 S 11/1999 McGahn et al. ..... D21/370
6,079,985 A * 6/2000 Wohl et al.
6,155,925 A * 12/2000 Giobbi et al.
6,186,894 B1 * 2/2001 Mayeroff
6,224,482 B1 * 5/2001 Bennett
6,224,483 B1 * 5/2001 Mayeroff
6,231,442 B1 * 5/2001 Mayeroff

FOREIGN PATENT DOCUMENTS

EP 0 993 847 A1 4/2000 ..... A63F/13/00
EP 1 000 642 A2 5/2000 ..... A63F/3/00

* cited by examiner

*Primary Examiner*—William M. Pierce
(74) *Attorney, Agent, or Firm*—Marshall, Gerstein & Borun LLP

(57) ABSTRACT

A game that utilizes a plurality of sound lines (or sound tracks) which are components of a song where each sound line or ensemble may be reproduced either alone or together with any number of other sound lines.

28 Claims, 6 Drawing Sheets

METHOD AND APPARATUS FOR PLAYING A GAME UTILIZING A PLURALITY OF SOUND LINES WHICH ARE COMPONENTS OF A SONG OR ENSEMBLE

The present invention generally relates to a method of playing a game utilizing a plurality of sound lines which are components of a song or ensemble, each of which may be reproduced either alone or together with any number of the other sound lines. The game is preferably included as an adjunct, secondary event, bonus feature to a basic casino video game.

BACKGROUND OF THE INVENTION

Listening to musical songs is increasingly becoming a favorite pastime and hobby. Historically songs have been recorded by assembling all of the musicians at a single location to perform the music, which was recorded in real time at the location. Also, a common recording technique involves using several microphones selectively placed about a recording studio where assembled musicians perform a song such that each microphone picks up sound primarily from a nearby one or group of the musicians and such that each microphone is used to record predominantly a single instrumentalistor vocalist, which recording is maintained on a separate recording track and is later mixed or layered with other tracks to create a recorded song. The recording engineers may filter certain sounds or frequencies from a particular track without affecting other tracks, may modify the volume of each track relative to other tracks (i.e., balance the tracks), and may perform other modifications to the tracks in connection with the mixing or layering operation.

More recent recording practices, especially those involving famous musicians or musicians in high demand, involve recording a particular musician playing his or her part in a recording studio on a particular day, and having a different musician performing his or her part at the same or a different recording studio, at a later time during the same day or on a different day. For example, a drummer may play the drum part of a song and have the drum performance recorded on a separate track, the bass player may play the bass part of a song and have that performance recorded on yet a different track, a piano player may play the piano part of a song and have that performance recorded on another track, etc., until all the parts have been recorded on separate tracks. The recording engineers will then appropriately modify and mix the tacks to create the final recording of the song.

SUMMARY OF THE INVENTION

The present invention involves a game that utilizes a plurality of sound lines (or sound tracks) which are components of a song or ensemble where each sound line may be reproduced either alone or together with any number of other sound lines.

BRIEF DESCRIPTION OF THE DRAWINGS

The present invention will be described with reference the accompanying drawings, wherein like reference numerals refer to the same item.

DESCRIPTION OF THE PREFERRED EMBODIMENTS

Figure 1:
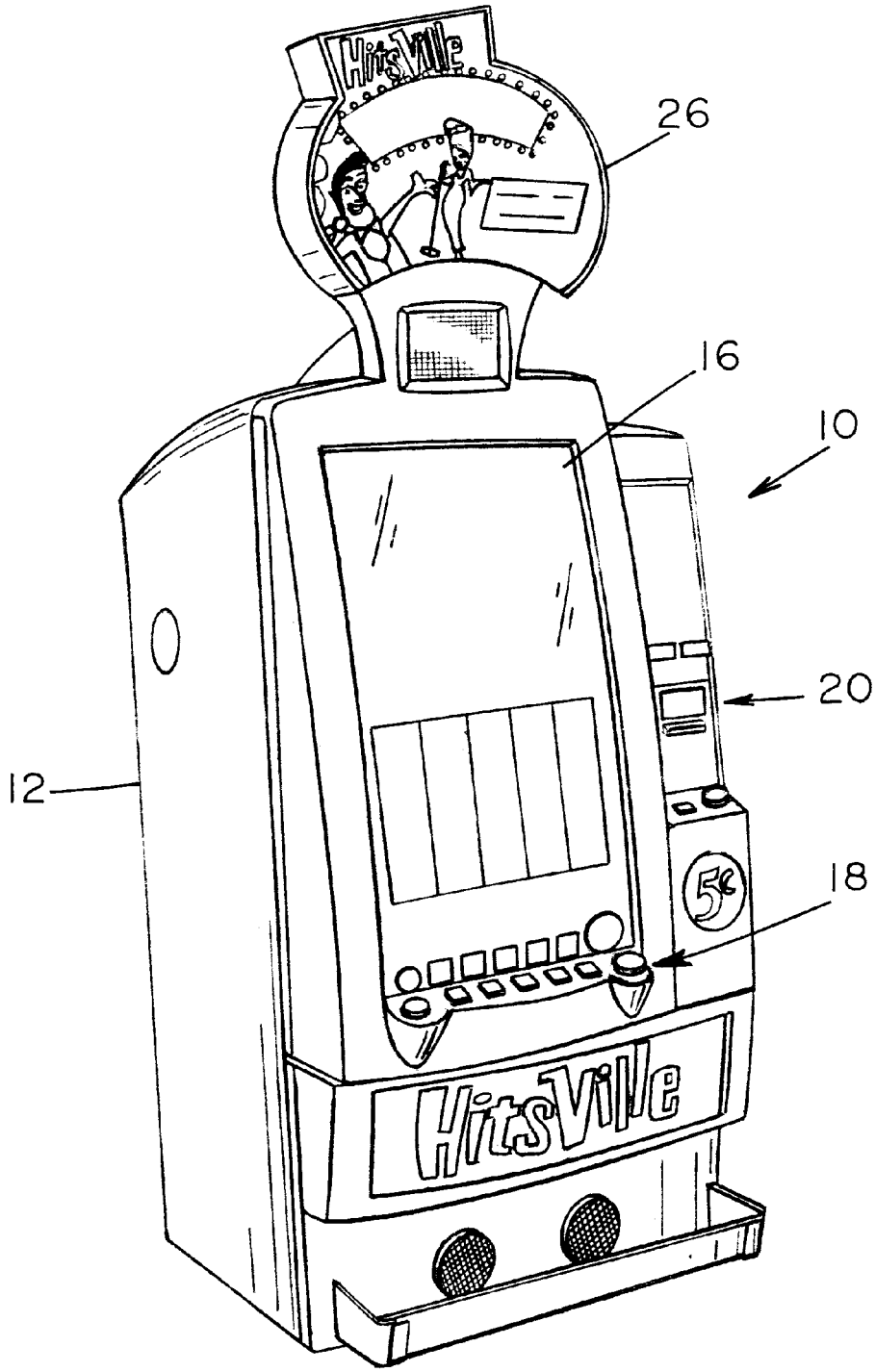
FIG. 1 is a perspective view of a casino video game machine that may be used in connection with the instant invention.

The invention will be described with reference to the accompanying drawings wherein like reference numerals refer to the same item. It is to be clearly understood that this preferred embodiment is provided for descriptive purposes only and is not meant to unduly limit the scope of the inventive concept. Other embodiments are included within the inventive concept as set forth in the appended claims.

As shown in FIG. 1, a casino video game machine 10 may be mounted on a machine base (not shown) and in front of which a player usually sits on a stool or chair (not shown). It should be appreciated from a further reading of the preferred embodiment that the instant invention may be employed with a wide variety of machines, however, such as a "slant top" machine and such as games played with computer monitor and keyboard.

The machine 10 includes a generally boxed shaped housing 12 that contains electronics and other equipment used in the operation of the game. The machine 10 also includes a video monitor 16, a series of game control buttons 18, and monetary acceptance devices 20, such as a bill validator, a coin comparator, and an electronic funds transfer device. A display sign 26 may be mounted on top of the machine 10. The present invention preferably includes a touch screen game controls that lay over the transparent window of the video monitor 16. As is well-known in the casino gaming art, the touch screen includes several areas or fields that are associated with a particular game function, and when a player touches the touch screen in the area of a particular field, then the function associated with that field will be activated. The invention also contemplates that game control devices in addition to game control buttons 18 and a touch screen may be utilized, such as a light pen, track ball, and a mouse.

Figure 2:
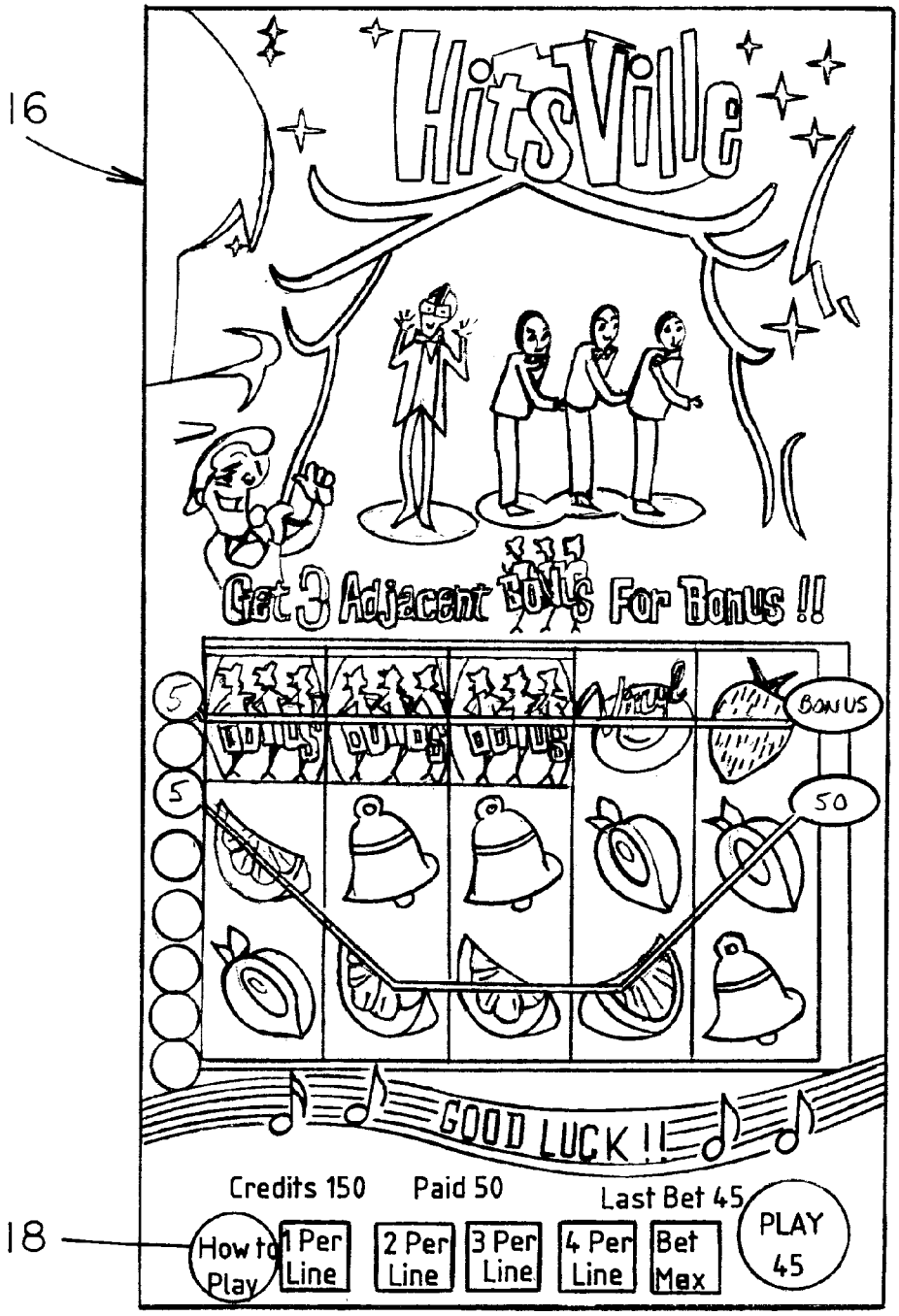
FIG. 2 is a schematic illustration of a video screen of the casino video game machine as shown in FIG. 1.

The present invention may be played either as an independent game or as an adjunct, secondary event, bonus feature to a basic game. In the preferred embodiment, the game is played as an adjunct, secondary event, bonus feature in connection with a basic game such as a five reel or virtual reel slot machine, as best shown in FIG. 2. A player may play the basic slot machine game in connection with the rules of play for the slot machine game. If the player achieves a predetermined bonus condition in the slot machine game, then the player is entitled to play a bonus game. The bonus condition may be, for example, three adjacent bonus symbols aligned on a pay line across the five reels as shown in FIG. 2.

Figure 3:
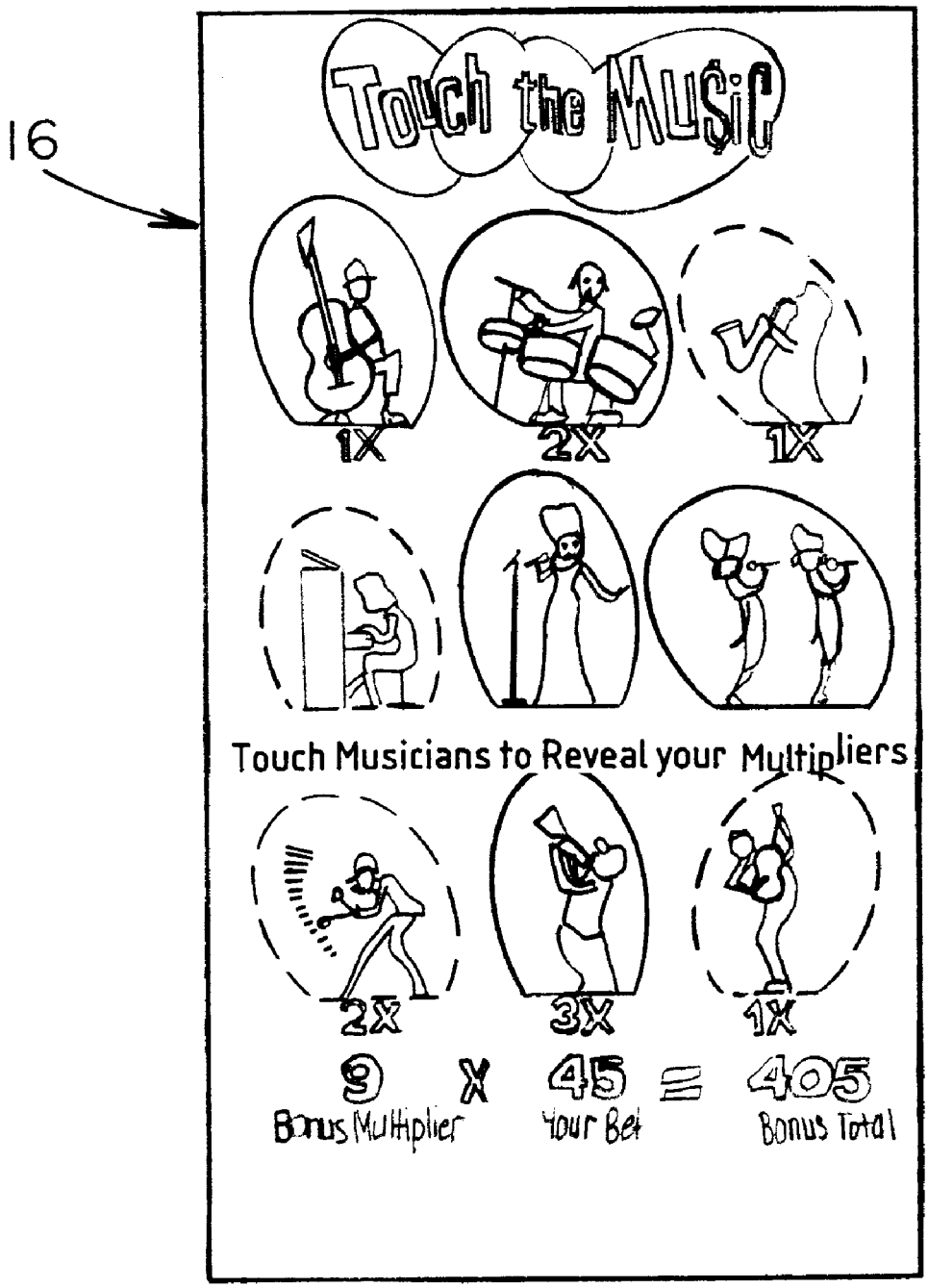
FIG. 3 is a second schematic illustration of a video screen of the casino video game machine as shown in FIG. 1.

In the bonus game of the instant invention, there is displayed on the video monitor 16 a rectangular 3×3 array of nine substantially oval shaped illustrations of musicians, some of which are instrumentalists and some of which are vocalists. Each illustration is associated with a corresponding field on the touch screen overlying the video monitor 16. Each oval depicts a particular type of musician such as an instrmentalist and the associated instrument, such as a group of instrumentalists and their associated instruments (e.g. a percussion section or brass section) or such as a vocalist, background singer or singers, or a group of singers (e.g., the soprano section). As shown in FIG. 3 the ovals are arranged from left-to-right and from top-to-bottom depicting a string bass player playing a string bass, a drummer playing a drum set, a saxophonist playing a saxophone, a pianist playing a piano, a lead singer, two background singers, a xylophonist playing a xylophone, a trumpeter playing a trumpet, and a guitarist playing a guitar. Initially all of the oval shaped illustrations are shown in a shadowing effect (shown in FIG. 3 as an oval formed by dotted lines) so that the outline of the musician and the instrument is shown in a relatively dark, uniform color against a light, uniform background in each oval area.

As a player touches a screen field overlying a particular oval, the illustration in the oval will "light up" in color (shown in FIG. 3 as an oval formed by solid lines) and a bonus value will be depicted beneath the oval, such as "1X." Simultaneously, the machine will cause to be played through a speaker associated with machine 10 the musical sound created by the musician depicted in the selected oval, which comprises a sound line or track component to a song. For example, if the player were to touch the oval illustrating the bass player, then the machine would play the bass line to a song.

The player may then select another oval illustration by again touching the touch screen field overlying the selected oval. Upon such touching of the touch screen field, the oval illustration "lights up" and shows the musician in color and shows a bonus value such as "2X" below the oval. The machine 10 simultaneously plays the musical sound associated with the second touched oval illustration, which is played simultaneously with the musical sound associated with the previously touched screen. For example, if the second touched screen field is the oval illustration depicting the drummer, then the machine would play the drum line or track to the song such that the drum sound would be mixed with, layered upon, or superimposed upon the continued playing of the bass line to the song. The player continues playing the game in a similar fashion until the player touches a touch screen field and the machine displays the word "collect" over the oval illustration. Such event will terminate the game, and then the player is entitled to receive all of the bonus values displayed until the "collect" sign is displayed.

It will be appreciated that if the player touches all nine of the fields above the nine oval illustrations in FIG. 3 before the "collect" sign is displayed, then the machine will play all of the sound tracks or lines for the song, so that the song is complete, and also, that the player will have achieved the highest bonus award possible.

FIG. 3 shows the following possible, hypothetical play of the game. The player initially touched the touch screen field above the drummer, then touched the touch screen field above the bass player, then touched the touch screen field above the background vocalists, and then touched the touch screen field above the lead singer, and lastly touched the touch screen field above the trumpeter. After touching the trumpeter, the machine will play through a speaker the sound lines associated with the bass player, drummer, background vocalist, lead singer, and trumpeter, but will not play the sound tracks or lines associated with the saxophonist, the pianist, the xylophonist, or the guitarist. The player will receive as a bonus award "1X" associated with the bass player, "2X" associated with the drummer, "1X" or "2X" associated with the lead vocalist (not shown), "2X" or "1X" (not shown) associated with the background vocalist, and "3X" associated with the trumpeter, for a total of "9X". The sum of 9 is used as a multiplier of the wager made by the player and associated with the basic game to arrive at a bonus total value. As shown in FIG. 3, the player placed a wager of 45 units, for a total bonus award of 405 units. As is well known in the industry, the units may typically comprise a nickel, quarter, or a dollar, and also may be any value.

The wager to be multiplied may be based upon the total amount wagered for the basic game. For example, a player of a slot machine may be given the option of placing one, two, three, or four quarters in the machine before spinning the reels. If the reels achieve a bonus situation enabling the player to play the bonus game, then the value of the player's winnings in the bonus game will be a multiple of the total value of the quarters the player placed in the slot machine prior to the spin which achieved the bonus condition. As another alternative, for example, in a Triple Play poker game, the player is given the option of playing up to three rows of five card hands of draw poker and is given the further option of designating how much to wager for each of the rows. If a hand in one of the rows achieves a bonus condition (such as a four of a kind) and the player is entitled to play a bonus game, then the winnings of the bonus game will be a multiple of the wager associated with the row containing the hand that achieved the bonus condition. And yet another alternative embodiment, the player may play a basic casino game of five reel slot machine containing nine pay lines. A bonus condition may be achieved by a bonus symbol appearing on three reels of a pay line. If the player is then entitled to play the bonus game, then any winnings may be a multiple of the wager associated with the pay line containing the three winning symbols. If, as a further example, the player achieved four bonus symbols on the same pay line, or five bonus symbols on the same pay line, then the value achieved on the bonus game may be doubled or tripled, respectively. It should also be appreciated that in addition to the bonus award being a multiple of a previous wager, each bonus award may be a fixed fee, for example, five dollars, or may be some other type of prize.

It should be appreciated that although FIG. 3 depicts a situation involving nine sound tracks or lines, any number of tracks greater than one could be utilized. Preferably, there are at least six sound lines.

Also the sound lines or tracks are preferably components of a popular, well-known "hit" song, however, any song may be utilized.

Figure 4:
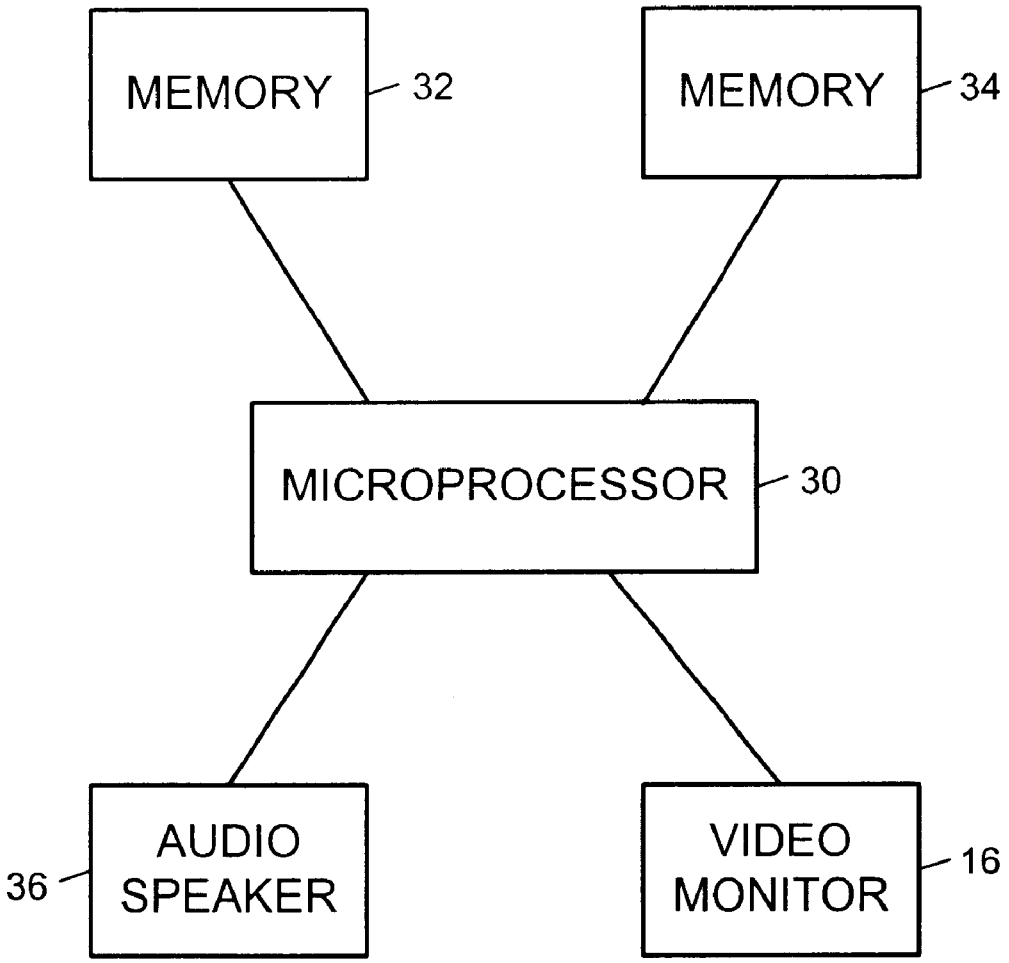
FIG. 4 is a block diagram of devices that are included within the casino video game machine shown in FIG. 1.

FIG. 4 shows a block diagram illustration of equipment that may be utilized in the machine 10 according to the preferred embodiment, including a microprocessor 30 operationally connected to a first memory device such as a cd-rom 32, to a second memory device such as a cd-rom 34, to an audio sound speaker 36, and to the video monitor 16. A plurality of musical sound lines comprising components of a song are loaded into the first memory device 32, and the graphic illustrations of the musicians, such as those appearing in FIG. 3, are loaded into the second memory device 34.

It should be appreciated that the fist memory device 32 and the second memory device 34 may be combined into a single memory device, but are described as separate memory devices for convenience and description.

It should be appreciated that as an alternative to the plurality of the musical sound lines comprising a single song being loaded into the first memory device 32, several songs with associated musical sound lines may be loaded into the first memory device 32. Also, especially where there is more than one song with component musical sound lines loaded into the first memory device 32, the second memory device 34 may include a variety of different illustrations of musicians. For example, in connection with a first song, the associated images or illustrations may be the nine illustrations shown in FIG. 3, and for a second song, there may be nine illustrations that are different in some respects from the nine illustrations in connection with the first song, and for a third song, there may be only four illustrations such as a dixieland band comprising a pianist, a trumpeter, a clarinetist, and a trombonist.

As shown in FIG. 3, the bonus values associated with each illustration may differ, although it is contemplated that the bonus values may be identical from illustration to illustration. If the bonus values are not identical, it is preferred that the bonus values associated with an illustration change from bonus game to bonus game so that a player does not learn where the highest bonus values are located. In such an alternative embodiment, the values may be randomly selected by the microprocessor 30 from a predetermined group of values.

In a preferred embodiment of the invention, microprocessor 30 will randomly select a number from one to the maximum number of illustrations to be displayed on the video monitor 16. For example, if there are nine illustrations to be displayed, then the computer may randomly select the number five, and when the player touches the fifth touch screen field, then the "collect" sign will appear, and the game will terminate. Also, the microprocessor 30 is preferably preprogrammed so that the sequential order of a player's touching of the touch screen fields corresponds with a preselected order of bonus values. So, for example, when the player touches the first touch screen field, the illustration associated with that field might have a bonus value of 1X, and the second touch screen field touched by the player would have an associated bonus value of 2X, the third touch screen field touched by the player would have an associated bonus value of 4X, and the fourth touch screen field touched by the player would have an associated bonus value of 2X, etc. In such a preferred procedure, a statistical average bonus value or award may be calculated.

The present invention also contemplates that the illustrations and the ovals may be statically displayed, or may be displayed in animation. Also, the musicians may be depicted as characters, or may be depictions of actual human musicians, especially stars such as Diana Ross as the lead singer. In this embodiment, it is preferred that the song be associated with the human musician, such as a popular song in which Diana Ross was the lead singer.

It should also be understood that the microprocessor 30 is programmed so as to introduce each layer of each song line at an appropriate point or time in the song, so, for example, if the string bass line is being played by the machine 10 and the player touches the touch screen field associated with the oval illustration for the drums, then the microprocessor 30 will determine where the bass line is in the song (such as the fourth beat of the 15th measure), and will introduce the drum sound line at the same location in the song so that the sound lines are in synchronization.

In an alternative embodiment, sound lines may be utilized which are other than musical sound lines forming components of a song. For example, each sound line may comprise an animal sound associated with the jungle and each oval illustration may depict the animal associated with the sound. By further example, the one oval illustration may be a parrot and when touched by the player may emit an associated parrot cackling sound, another oval illustration may be an elephant that emits an elephant trumpeting sound, a lion emitting a lion roar, etc. It is also contemplated that one of the jungle sounds may be a "Tarzan"-like yodel associated with an oval illustration of a scantily clad human. It will be appreciated that the addition of each jungle sound will not necessarily produce a song, but will produce an ensemble of sounds which have an associated jungle theme.

In yet another alternative embodiment of the present invention, the sound lines may be sequentially subtracted from an ensemble of sounds. For example, as the player starts the bonus feature, the sounds from several cars in a demolition derby may be emitted in an ensemble effect. As the player selects each oval depiction of an associated car in the demolition derby, such car may be disabled and the car's associated sound will be deleted from the ensemble. The process is continued until the machine displays the word "collect" over the selected oval illustration in the manner previously described herein.

Figure 5:
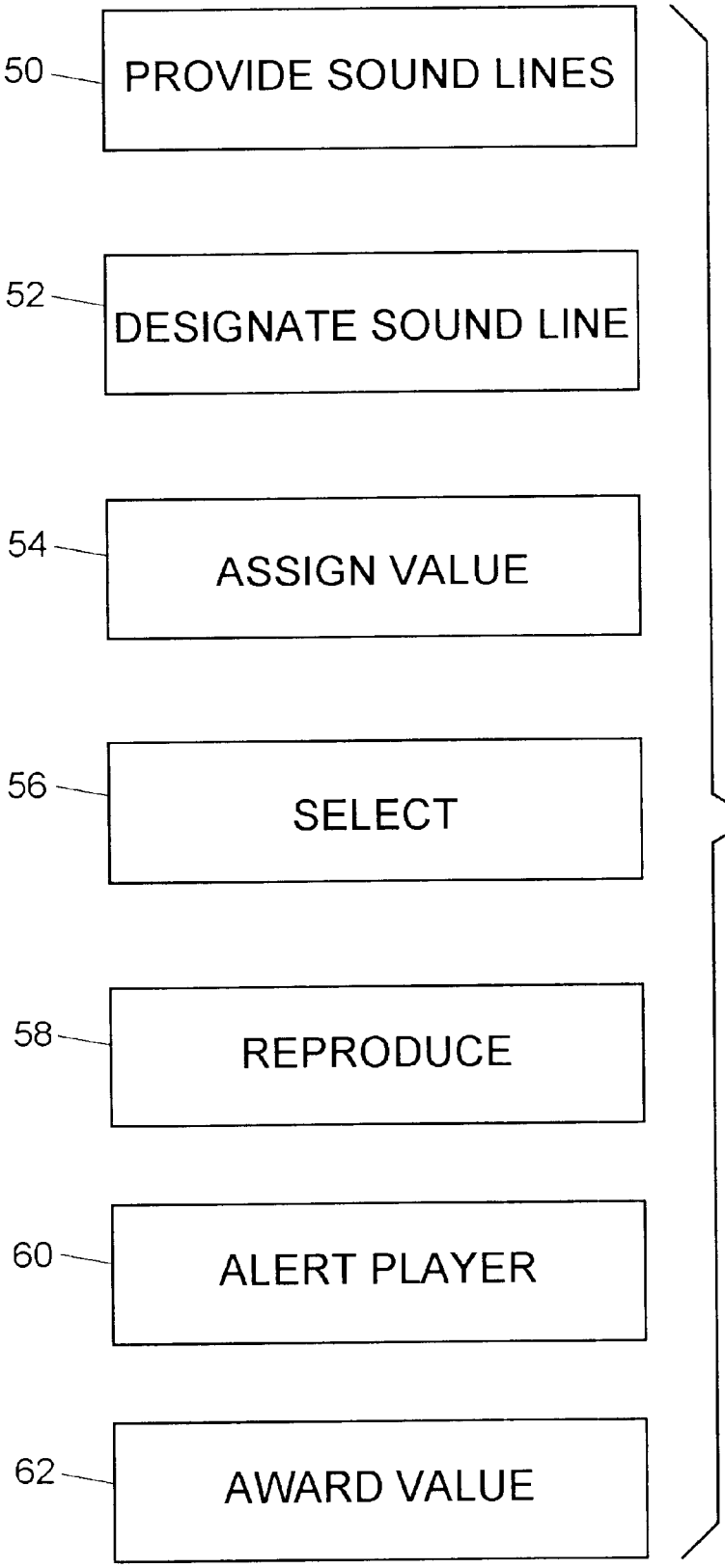
FIG. 5 illustrates the steps of one embodiment of a method of playing a game.

Referring to FIG. 5 in one embodiment, a method of playing an audio game comprises the steps of (a) providing a plurality of sound lines which are components of a song or ensemble, each of which may be reproduced either alone or together with any number of other sound lines (block 50); (b) secretly designating a particular sound line for completing the game (block 52); (c) assigning a value to each sound line (block 54); (d) affording a player of the game an opportunity to sequentially select individual sound lines (block 56); (e) sequentially reproducing each sound line in response to the player's selection of such sound line until the player selects said designated sound line (block 58); (f) alerting the player when the player selects said designated sound line (block 60); and (g) awarding to the player the value assigned to each sound line until the player selects said designated sound line (block 62).

Figure 6:
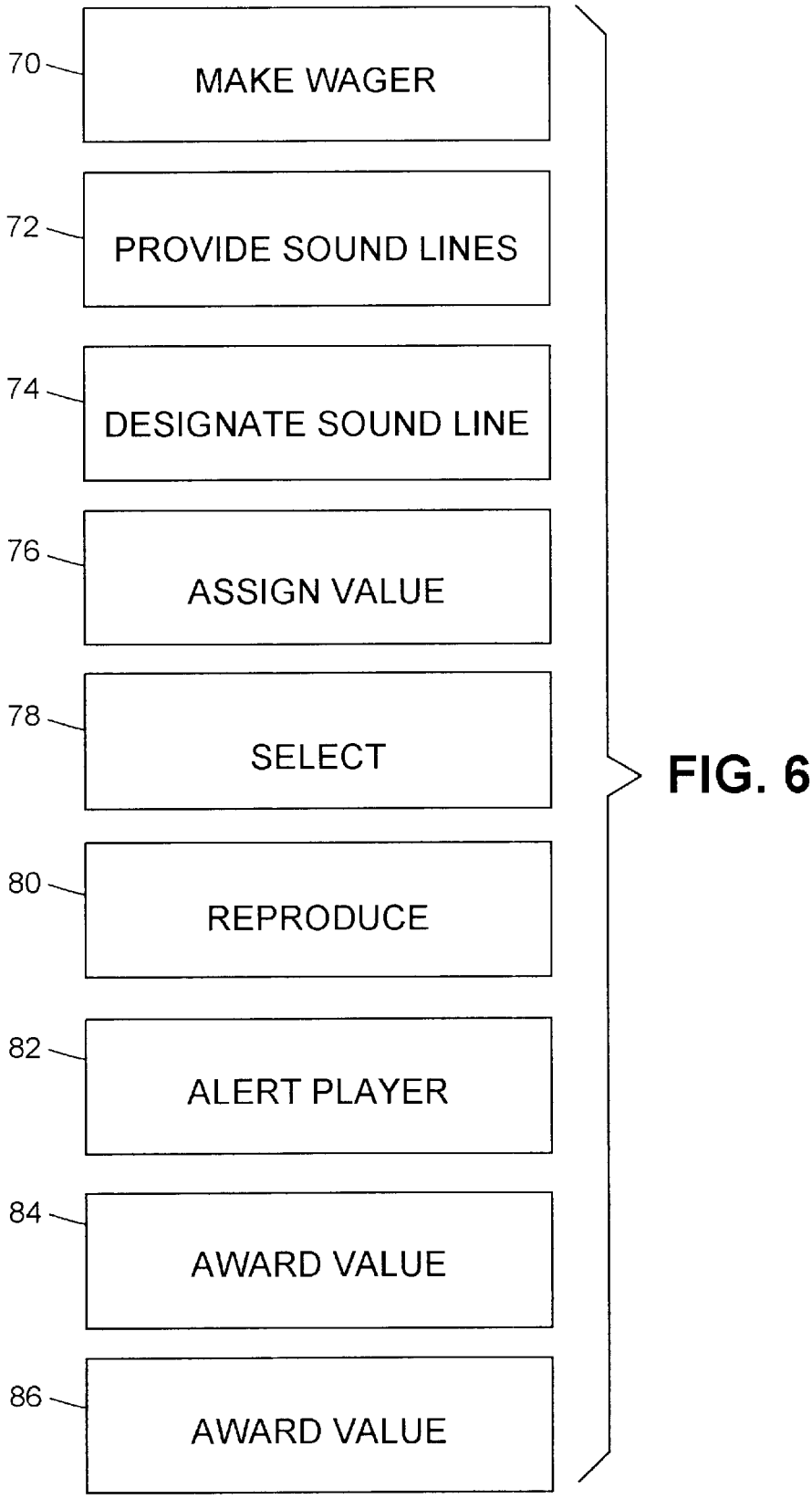
FIG. 6 illustrates the steps of one embodiment of a method of playing a game.

Referring to FIG. 6, in one embodiment, a method of playing an audio wagering game comprises the steps of (a) affording a player an opportunity to make a wager to play the game (block 70); (b) providing a plurality of sound lines which are components of a song or ensemble, each of which may be reproduced either alone or together with any number of other sound lines (block 72); (c) secretly designating a particular sound line for completing the game (block 74); (d) assigning a value to each sound line (block 76); (e) affording a player of the game an opportunity to sequentially select individual sound lines (block 78); (f) sequentially reproducing each sound line in response to the player's selection of such sound line until the player selects said designated sound line (block 80); (g) alerting the player when the player selects said designated sound line (block 82); (h) awarding to the player the value assigned to each sound line until the player selects said designated sound line (block 84); and (i) resolving the player's wager according to the value awarded to the player (block 86).

Although particular embodiments of the particular invention are described and illustrations herein, it should be recognized that modifications and variations may readily occur to those skilled in the art and that such modifications and variations may be made without departing from the spirit and scope of our invention. Consequently, our invention as claimed below may be practiced otherwise than as specifically described above.

What is claimed is:

1. A method of playing an audio game comprising the steps of:

(a) providing a plurality of sound lines which are components of a song or ensemble, each of which may be reproduced either alone or together with any number of other sound lines;

(b) secretly designating a particular sound line for completing the game;

(c) assigning a value to each sound line;

(d) affording a player of the game an opportunity to sequentially select individual sound lines;

(e) sequentially reproducing each sound line in response to the player's selection of such sound line until the player selects said designated sound line;

(f) alerting the player when the player selects said designated sound line; and (g) awarding to the player the value assigned to each sound line until the player selects said designated sound line.

2. The method according to claim 1 wherein the value is assigned secretly and comprising the further step of revealing to the player the value assigned to each sound line as such sound line is selected by the player until the player selects said designated sound line.

3. The method according to claim 1 wherein said designated round line is randomly designated from all of said sound lines.

4. The method according to claim 2 wherein said designated sound line is randomly designated from all of said sound lines.

5. The method according to claim 1 wherein said plurality numbers at least six.

6. The method according to claim 1 wherein each sound line consists essentially of musical sounds corresponding to an instrument or voice and wherein the instrument or voice corresponding to the musical sounds of one sound line is substantially different from the instrument or voice corresponding to the musical sounds of each other sound line.

7. The method according to claim 4 wherein each sound line consists essentially of musical sounds corresponding to an instrument or voice and wherein the instrument or voice corresponding to the musical sounds of one sound line is substantially different from the instrument or voice corresponding to the musical sounds of each other sound line.

8. The method according to claim 1 wherein each sound line is substantially continuously reproduced after the player's selection of such sound line whereby the reproduction of later selected sound lines overlaps in time with the continued reproduction of earlier selected sound lines until the player selects the designated sound line.

9. The method according to claim 6 wherein each sound line is substantially continuously reproduced after the player's selection of such sound line whereby the reproduction of later selected sound lines overlaps in time with the continued reproduction of earlier selected sound lines until the player selects the designated sound line.

10. The method according to claim 7 wherein each sound line is substantially continuously reproduced after the player's selection of such sound line whereby the reproduction of later selected sound lines overlaps in time with the continued reproduction of earlier selected sound lines until the player selects the designated sound line.

11. The method according to claim 8 wherein at least four of the different instruments or voices are selected from the group consisting of: string bass, keyboard, drums, saxophone, trumpet, guitar, xylophone, lead singer, and background vocals.

12. A method of playing an audio wagering game comprising the steps of:

(a) affording a player an opportunity to make a wager to play the game; and (b) providing a plurality of sound lines which are components of a song or ensemble, each of which may be reproduced either alone or together with any number of other sound lines;

(c) secretly designating a particular sound line for completing the game;

(d) assigning a value to each sound line;

(e) affording a player of the game an opportunity to sequentially select individual sound lines;

(f) sequentially reproducing each sound line in response to the player's selection of such sound line until the player selects said designated sound line;

(g) alerting the player when the player selects said designated sound line;

(h) awarding to the player the value assigned to each sound line until the player selects said designated sound line.

(i) resolving the player's wager according to the value awarded to the player.

13. The method according to claim 12 wherein the value is assigned secretly and comprising the further step of revealing to the player the value assigned to each sound line as such sound line is selected by the player until the player selects said designated sound line.

14. The method according to claim 12 wherein said designated sound line is randomly designated from all of said sound lines.

15. The method according to claim 13 wherein said designated sound line is randomly designated from all of said sound lines.

16. The method according to claim 12 wherein said plurality numbers at least six.

17. The method according to claim 12 wherein each sound line consists essentially of musical sounds corresponding to an instrument or voice and wherein the instrument or voice corresponding to the musical sounds of one sound line is substantially different from the instrument or voice corresponding to the musical sounds of each other sound line.

18. The method according to claim 15 wherein each sound line consists essentially of musical sounds corresponding to an instrument or voice and wherein the instrument or voice corresponding to the musical sounds of one sound line is substantially different from the instrument or voice corresponding to the musical sounds of each other sound line.

19. The method according to claim 12 wherein each sound line is substantially continuously reproduced after the player's selection of such sound line whereby the reproduction of later selected sound lines overlaps in time with the continued reproduction of earlier selected sound lines until the player selects the designated sound line.

20. The method according to claim 17 wherein each sound line is substantially continuously reproduced after the player's selection of such sound line whereby the reproduction of later selected sound lines overlaps in time with the continued reproduction of earlier selected sound lines until the player selects the designated sound line.

21. The method according to claim 18 wherein each sound line is substantially continuously reproduced after the player's selection of such sound line whereby the reproduction of later selected sound lines overlaps in time with the continued reproduction of earlier selected sound lines until the player selects the designated sound line.

22. The method according to claim 19 wherein at least four of the different instruments or voices are selected from the group consisting of: string bass, keyboard, drums, saxophone, trumpet, guitar, xylophone, lead singer, and background vocals.

23. A video casino game machine comprising:

(a) first memory means for electronically storing a plurality of sound lines which are components of a song or ensemble;

(b) second memory means for electronically storing a plurality of images, each of which is associated with a corresponding sound line;

(c) speaker means for electronically emitting an audible sound;

(d) video display means for electronically displaying images to a player;

(e) touch screen means associated with said video display means and possessing an array of fields for enabling a player to initiate a game control command by touching a field; and (f) a microprocessor means operationally connected to said first memory means, said second memory means, said speaker means, said video display means and said touch screen means, whereby said microprocessor means is adapted to cause images stored in said second memory means to be displayed by said video display means in an array corresponding to the array of fields of said touch screen means such that an image is displayed in a corresponding field, whereby when a player touches a field said microprocessor means is adapted to cause a sound line stored in said first memory means that corresponds with the image displayed in the touched field to be emitted by said speaker means.

24. A video casino game machine according to claim 23 further comprising wagering means by which a player may make a wager to play the game.

25. A video casino game machine according to claim 24 wherein said plurality of sound lines number at least six lines and wherein said plurality of images number at least six images.

26. A video casino game machine comprising:

memory means for electronically storing a plurality of sound lines which are components of a song or ensemble and a plurality of images, each of which is associated with a corresponding sound line;

speaker means for electronically emitting an audible sound;

video display means for electronically displaying images to a player;

touch screen means associated with said video display means and possessing an array of fields for enabling a player to initiate a game control command by touching a field; and a microprocessor means operationally connected to said memory means, said speaker means, said video display means and said touch screen means, whereby said microprocessor means is adapted to cause images stored in said memory means to be displayed by said video display means in an array corresponding to the array of fields of said touch screen means such that an image is displayed in a corresponding field, whereby when a player touches a field said microprocessor means is adapted to cause a sound line stored in said memory means that corresponds with the image displayed in the touched field to be emitted by said speaker means.

27. A video casino game machine according to claim 26 further comprising wagering means by which a player may make a wager to play the game.

28. A video casino game machine according to claim 26 wherein said plurality of sound lines number at least six lines and wherein said plurality of images number at least six images.

* * * * *

UNITED STATES PATENT AND TRADEMARK OFFICE

CERTIFICATE OF CORRECTION

PATENT NO. : 6,729,618 B1
DATED : May 4, 2004
INVENTOR(S) : Nicholas Koening et al.

It is certified that error appears in the above-identified patent and that said Letters Patent is hereby corrected as shown below:

Column 7,
Line 2, please delete "comprising the further step of revealing" and insert -- comprising revealing --.

Column 8,
Line 14, please delete "line." and insert -- line; and --.
Line 21, please delete "comprising the further step of revealing" and insert -- comprising revealing --.

Signed and Sealed this

Twelfth Day of October, 2004

JON W. DUDAS
*Director of the United States Patent and Trademark Office*